United States Patent [19]

Koch

[11] Patent Number: 4,747,190

[45] Date of Patent: May 31, 1988

[54] APPARATUS FOR INFLATING A LENGTH OF TUBULAR MATERIAL

[75] Inventor: Werner Koch, Wald-Michelbach, Fed. Rep. of Germany

[73] Assignee: Bruckner Apparatebau GmbH, Erbach/Odenwald, Fed. Rep. of Germany

[21] Appl. No.: 2,240

[22] Filed: Jan. 9, 1987

[30] Foreign Application Priority Data

Jan. 10, 1986 [DE] Fed. Rep. of Germany ..... 3600558

[51] Int. Cl.[4] ..... D06C 3/00; D06B 5/08

[52] U.S. Cl. ..... 26/74; 26/80; 68/13 R; 68/20

[58] Field of Search ..... 68/13 R, 20; 26/75, 26/80, 85, 74; 15/306 A, 319

[56] References Cited

U.S. PATENT DOCUMENTS 4,318,209 3/1982 Schuierer ..... 26/80 X

FOREIGN PATENT DOCUMENTS 15554 1/1984 Japan ..... 68/13 R

*Primary Examiner*—Philip R. Coe

*Attorney, Agent, or Firm*—C. O. Marshall, Jr.

[57] ABSTRACT

The invention relates to apparatus for inflating a continuously moving length of tubular material, in which the nozzle tube is rotatable and an arrangement is provided which locks the nozzle tube in an angular position in which the nozzle is in contact with the length of material during the discharge of gas from the nozzle. Such apparatus is distinguished during the greater part of the production time by a considerable reduction in the friction between the length of material and the nozzle tube.

3 Claims, 3 Drawing Sheets

FIG. 4
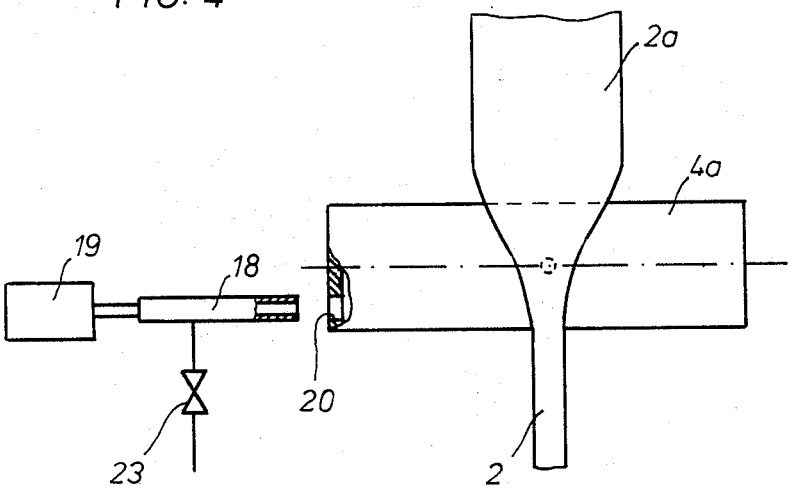
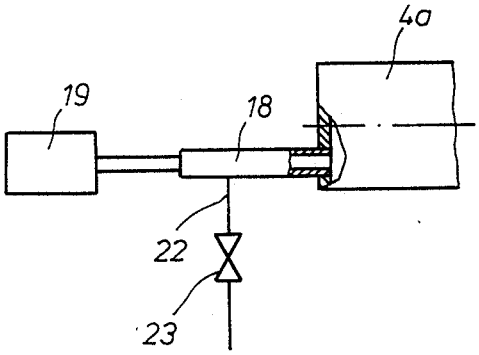
FIG. 5

APPARATUS FOR INFLATING A LENGTH OF TUBULAR MATERIAL

The invention relates to apparatus for inflating a continuously moving length of tubular material.

Apparatus for dyeing a continuously moving length of tubular material is known in which the material which has been padded with the dye runs into a steaming chamber which contains a tank of fixing fluid in its lower region. The material first of all passes through this tank, absorbs fixing fluid and then passes to a fixed nozzle tube which contains at least one nozzle through which a gaseous medium (e.g. air, nitrogen, steam) is blown into the tubular material. The inflated section formed hereby is approximately round and its entire surface should be covered as evenly as possible with fixing fluid in order to achieve optimum fixing. Only when this is ensured is the quality of the dyeing uniformly good without any bend marks remaining.

Practical experience with such known apparatus has shown that nozzle tube which serves for introduction of the gaseous medium into the length of tubular material has an unfavourable effect upon the distribution of the fluid at the periphery of the length of material. It has been generally established that the regions of the tubular material which come into contact with the fixed nozzle tube contain less fluid after passing the nozzle tube than do the other zones of the material. In other words, the nozzle tube of the known apparatus wipes fluid off from the periphery of the tubular material, which leads to an uneven fixing effect.

The object of the invention, therefore, is to construct apparatus of the type set out in such a way that a considerably more even distribution of the fluid is achieved over the entire periphery of the length of material after it has passed the nozzle tube.

This object is achieved according to the invention.

Advantageous embodiments of the invention are the subject matter of the subordinate claims.

In the tests on which the invention is based it was established that in generic apparatus as a general rule (that is to say in the treatment of lengths of well-sewn tubular material) it is only necessary to supply air to the inflated section for a small fraction of the total production time, since it is only necessary to replace the relatively low air losses from the inflated section formed by the tubular material.

The invention is also based upon the knowledge acquired in the tests that the effect of marked holding back of the fluid by the fixed nozzle tube which was observed in the previously known apparatus is caused by the considerable friction between the moving length of tubular material and the fixed nozzle tube.

Accordingly the apparatus according to the invention uses a rotatable nozzle tube which is entrained by the length of material for the greater part of the time (that is to say whenever no supply of gas to the inflated section is necessary) so that in this predominant time period no significant friction occurs between the length of material and the moving nozzle tube. It is only in the brief periods during which the gaseous medium is to be introduced into the length of tubular material through the nozzle in order to stabilise the inflated section that the nozzle tube is locked in an angular position which is suitable for this purpose (in which the nozzle is in contact with the length of material). The restriction in the fluid distribution occurring during this very brief time span is negligible in practice because of the increased friction between the locked nozzle tube and the moving length of material, since the fluid distribution becomes even again as soon as the nozzle tube rotates again.

Compared with a theoretically conceivable solution in which the nozzle tube rotates continuously (that is to say also during the supply of gas) so that a considerable proportion of the gaseous medium is blown uncontrolled into the surroundings as long as the nozzle is not in contact with the length of tubular material, the solution according to the invention has the advantage of a considerable reduction in the consumption of the gaseous medium; in addition disruptions in the surroundings (such as a build-up of foam in the fluid tank) are avoided.

One embodiment of the invention is illustrated in the drawings, in which:

FIGS. 4 and 5 show partially cut-away longitudinal views of the nozzle tube (with the gas supply connected and disconnected respectively).

Figure 1:
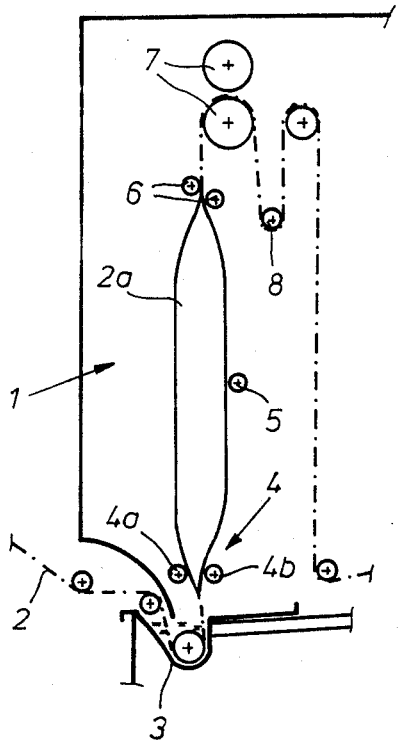
FIG. 1 shows a schematic representation of a chamber for fixing a length of dyed tubular material.

FIG. 1 shows one of a plurality of chambers 1 for dyeing a continuously moving length of tubular material 2. A tank 3 in which the length of material which has been padded with dye absorbs fixing fluid is provided in the lower region of the chamber 1.

The length of material 2 then passes through an arrangement 4 which serves to introduce a gaseous medium (such as air, nitrogen, steam) into the length of tubular material 2 and thereby to form it into an inflated section 2*a*.

For this purpose the arrangement 4 contains a rotating nozzle tube 4*a* and an opposed roller 4*b* which is also rotatably mounted and preferably constructed with the same diameter as the nozzle tube 4*a*, and the length of material 2 is passed between the nozzle tube 4*a* and the opposed roller 4*b*.

In the region where the material is inflated a sensing element 5 rests on the inflated section 2*a* and controls the supply of the gaseous medium through the nozzle tube 4*a* so that the shape and size of the inflated section 2*a* are kept stable.

The top of the inflated section 2*a* is defined by a first pair of rollers 6 which serves to hold back the gaseous atmosphere in the inflated section 2*a*.

A second pair of rollers 7 is arranged in the direction of movement behind the pair of rollers 6 and in the illustrated arrangement where the length of material 2 is guided vertically the pair of rollers 7 is located above the pair of rollers 6 and the inflated section 2*a*. The gap between the rollers is advantageously set so that after the length of material 2 has passed through the pair of rollers 7 it still has a fluid content of between 150 and 250% (based upon the weight of the length of material). The fluid held back by the pair of rollers 7 flows downwards at the periphery of the inflated section 2*a* and also serves to equalise the fluid distribution over the periphery of the length of tubular material.

A compensating roller 8 serves to regulate the speed of the rollers 7 of which one roller is advantageously driven.

Figure 3:
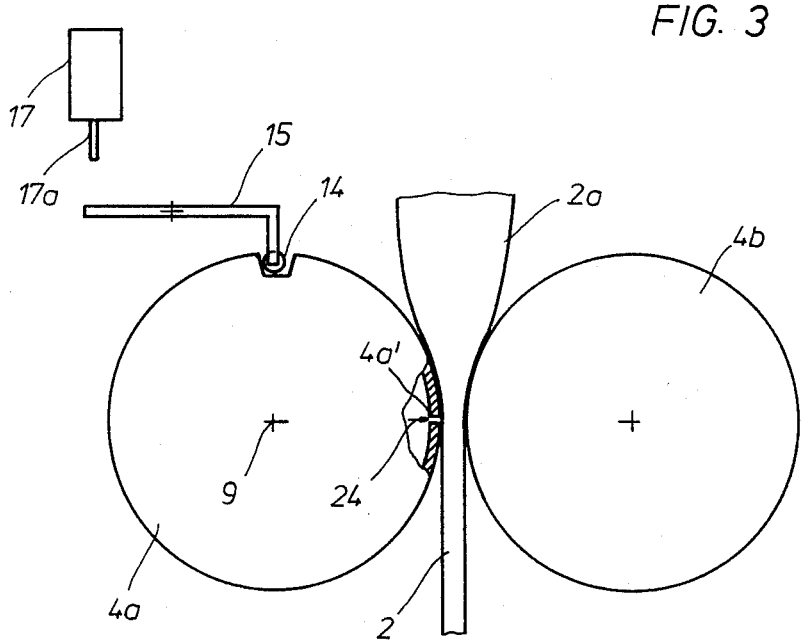
FIGS. 2 and 3 show partial representations (on an enlarged scale) of the nozzle tube for introducing the gaseous medium into the length of tubular material (in the freely rotatable or locked positions respectively)
Figure 2:
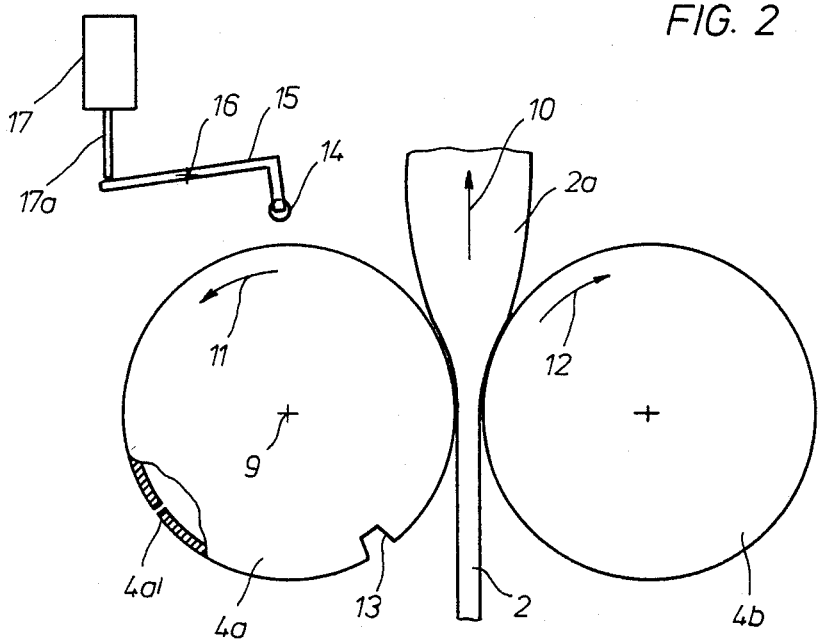

The nozzle tube 4*a* contains on its periphery at least one nozzle 4*a'* and is mounted so as to be freely rotatable about an axis 9 (FIGS. 2, 3). During the greater part of the production time the nozzle tube 4*a* is not locked (FIG. 2), so that it is entrained (arrow 11) by the length of material moving in the direction of the arrow 10. The same applies to the opposed roller 4*b* (arrow 12).

The nozzle tube 4*a* has on its periphery a groove-like recess 13 into which a roller 14 can fall like a latch. The roller 14 is carried by a two-armed lever 15 which is pivotable about an axis 16 and is acted upon by an operating cylinder 17. If the piston rod 17*a* of the operating cylinder 17 is driven out (FIG. 2), the roller 14 is lifted from the periphery of the nozzle tube 4*a* so that the nozzle tube 4*a* can rotate.

If the sensing element 5 (FIG. 1) given the instruction to supply the gaseous medium to the inflated section 2*a*, the piston rod 17*a* of the operating cylinder 17 is driven in. Consequently the roller 14 lies on the periphery of the nozzle tube 4 until in a specific angular position it falls into the recess 13 and locks the nozzle tube 4*a*. In this angular position the nozzle 4*a'* is in contact with the length of material 2.

In this locking angular position of the nozzle tube 4*a* a gas supply pipe 18 (FIGS. 4 and 5) which is arranged in a fixed angular position is pushed by means of an operating cylinder 19 in the axial direction of the nozzle tube 4*a* in such a way that the opening of the gas supply pipe 18 comes into engagement with an opening 20 at the end of the nozzle tube 4*a* (FIG. 5).

If a valve 23 in the pipe 22 leading to the gas supply pipe 18 is opened, the gaseous medium flows into the nozzle pipe 4*a* and passes via the nozzle 4*a'* into the inflated section 2*a* (arrow 24 in FIG. 3).

When the supply of gas is ended the gas supply pipe 18 is withdrawn by means of the operating cylinder 19 into the position according to FIG. 4 and the roller 14 is lifted out of the recess 13 by actuation of the cylinder 17. The nozzle tube 4*a* is then free to rotate again so that it only exerts minimal friction on the length of material 2. As a result the rotatable nozzle tube 4*a* and the rotatable opposed roller 4*b* hardly wipe any solution from the length of material 2. Consequently the periphery of the inflated section 2*a* is covered with a uniform film of fluid, which ensures an optimum fixing effect.

I claim:

1. Apparatus for inflating a continously moving length of tubular material (2) with a gaseous medium, containing (a) a nozzle tube (4*a*) which is arranged at right angles to the length of material (2), is in contact with the length of material and has at least one nozzle (4*a'*) for discharging the gaseous medium into the tubular material (b) an arrangement for controlling the discharge of the gaseous medium from the nozzle (4*a'*), characterised by the following features:

(c) the nozzle tube (4*a*) is arranged so as to be rotatable, (d) an arrangement (13, 14) is provided which locks the nozzle tube (4*a*) in an angular position in which the nozzle (4*a'*) is in contact with the length of material (2) during the discharge of the gaseous medium from the nozzle (4*a'*), (e) the nozzle tube (4*a*) is mounted so as to be freely rotatable and to be entrained by the moving material (2) when the nozzle tube is not locked.

2. Apparatus as claimed in claim 1, characterised in that an opposed roller (4*b*) which is also mounted so as to be rotatable and has the same diameter as the nozzle tube (4*a*) is associated with the nozzle tube (4*a*) in such a way that the length of material (2) is guided between the nozzle tube (4*a*) and the opposed roller (4*b*).

3. Apparatus as claimed in claim 1, characterised in that a gas supply pipe (18) which is arranged in a fixed angular position is coupled to the nozzle tube in the locking angular position of the nozzle tube (4*a*), by displacement of the gas supply pipe (18) in the axial direction of the nozzle tube (4*a*).

* * * * *